US006754968B2

(12) United States Patent
Lee

(10) Patent No.: US 6,754,968 B2
(45) Date of Patent: Jun. 29, 2004

(54) AIMING APPARATUS FOR A SLINGSHOT

(76) Inventor: Aldric K. Lee, 4525 Production Dr., Dallas, TX (US) 75235

( * ) Notice: Subject to any disclaimer, the term of this patent is extended or adjusted under 35 U.S.C. 154(b) by 0 days.

(21) Appl. No.: 09/995,984

(22) Filed: Nov. 19, 2001

(65) Prior Publication Data

US 2003/0093908 A1 May 22, 2003

(51) Int. Cl.[7] ..... G01C 1/00

(52) U.S. Cl. ..... 33/263; 33/265; 33/286; 33/DIG. 21; 124/17; 124/18

(58) Field of Search ..... 33/263, 265, 286, 33/DIG. 21; 124/17, 18, 20.1

(56) References Cited

U.S. PATENT DOCUMENTS 4,179,613 A * 12/1979 Koren ..... 33/265
4,250,861 A * 2/1981 Ellenburg ..... 124/20.1
5,152,068 A * 10/1992 Meister et al. ..... 33/265
5,157,839 A * 10/1992 Beutler ..... 33/265
5,201,122 A * 4/1993 Annunziata ..... 33/265
5,419,050 A * 5/1995 Moore ..... 33/DIG. 21
5,495,675 A * 3/1996 Huang ..... 33/265
5,894,672 A * 4/1999 Ellenburg et al. ..... 124/20.1
6,134,793 A * 10/2000 Sauers ..... 33/286
6,366,344 B1 * 4/2002 Lach ..... 33/265

* cited by examiner

*Primary Examiner*—Christopher W. Fulton
*Assistant Examiner*—Amanda J Hoolahan
(74) *Attorney, Agent, or Firm*—Harry C. Post, III

(57) ABSTRACT

An aiming apparatus for a slingshot. The aiming apparatus comprises a light projecting device adapted to project a light beam. A mounting apparatus is adapted to support the light projecting device on the slingshot and disposes the light projecting device with the light beam directed toward a target of a user of the slingshot.

22 Claims, 3 Drawing Sheets

AIMING APPARATUS FOR A SLINGSHOT

BACKGROUND OF THE INVENTION

This invention relates to an aiming apparatus for a slingshot and, more particularly, to a light projecting device illuminating a point on a target toward which a projectile is to be launched from a slingshot.

Slingshots have been used for many years. Normally, a user of the slingshot wraps a pouch around a projectile, overcomes the resistance caused by elastic members connected to the arms of forked member and moves the pouch into a projectile launching position. The user normally guesses where to hold the forked member and pouch in order for the released projectile to strike the target. In order to eliminated this guesswork, a slingshot aiming apparatus is provided for use by the slingshot user.

Accordingly, it is an object of the present invention to provide an aiming apparatus for a slingshot that eliminates the guesswork when using a slingshot without such aiming apparatus.

BRIEF SUMMARY OF THE INVENTION

In accordance with the present invention, there is provided an aiming apparatus for a slingshot that has a light projecting device adapted to project a light beam. Mounting apparatus is adapted to support the light projecting device on the slingshot so that the light beam is directed toward a target by a user of the slingshot.

Further, in accordance with the present invention, there is provided an aiming apparatus for use with a slingshot. The aiming apparatus has a light projecting device adapted to project a light beam. The light projecting device has a light projecting end to project the light beam toward a target of a user of the slingshot. The light projecting device is supported on the slingshot by mounting apparatus that includes an elastic member interconnecting first and second arms of the slingshot to the light projecting end of the light projecting device. An aligning apparatus aligns the light beam with a target by using a flexible and elongated member. This member has a length sufficient to be held by a user of the slingshot. The member also has a first end connected to the light projecting device with the light beam projecting away from the flexible and elongated member and a second end disposed for directing the light beam into alignment with a target as the slingshot is moved into a projectile launching position.

Further, in accordance with the present invention, there is provided an aiming apparatus for use with a slingshot. The aiming apparatus comprises a light projecting device adapted to project a light beam. The light projecting device includes a support body having a light projecting end to project the light beam, a light source connected to the body and a switch to selectively activate and deactivate the light source. Mounting apparatus is adapted to support said light projecting device and includes a mounting bracket to support the light projecting device. The mounting bracket has a directing shoulder and first and second elastic members. Each elastic member has first and second ends. The first end of each elastic member is connected to an arm of the slingshot in close proximity to the location of attachment by a slingshot elastic member. The second end of each elastic member is connected to the mounting bracket. A connecting apparatus connects the light projecting device to the mounting bracket. The connecting apparatus of the mounting apparatus has a first adjustable connecting device to adjust the light projecting device relative to the mounting bracket within a first plane. A second adjustable connecting device adjusts the light projecting device relative to the mounting bracket within a second plane. The first and second planes are disposed to extend in directions that are substantially transverse to one another. Movement restricting apparatus allows substantially unfettered constricting movement of the elastic mounting members while inhibiting other movement of the elastic member subsequent to the projectile being launched from the slingshot. The movement restricting apparatus includes an elongated tube disposed to extend around each elastic member and along the constricting axis of the elastic member. The elongated tube of the movement restricting apparatus has a length less than a length of the respective elastic member prior to being moved to a projectile launching position. Aligning and light activating apparatus is provided to align the light beam with a target and activate the light source of the light projecting device in response to the slingshot being moved into the projectile launching position. The aligning and light activating apparatus includes a flexible and elongated member having a length sufficient to be connected to a support body of the light projecting device, to engage the light switch of the light projecting device, to movably engage the directing shoulder of the mounting bracket and to be held by a user of the slingshot. A first end is connected to the body of the light projecting device with the light beam projecting away from the flexible and elongated member. A second end of the flexible and elongated member is disposed for directing the light beam into alignment with a target as the slingshot is moved into the projectile launching position.

BRIEF DESCRIPTION OF THE SEVERAL VIEWS OF THE DRAWING

Objects and advantages of the invention will become apparent upon reading the following detailed description and upon reference to the drawings, wherein like reference characters are used throughout to designate like parts.

DETAILED DESCRIPTION OF THE INVENTION

Figure 1:
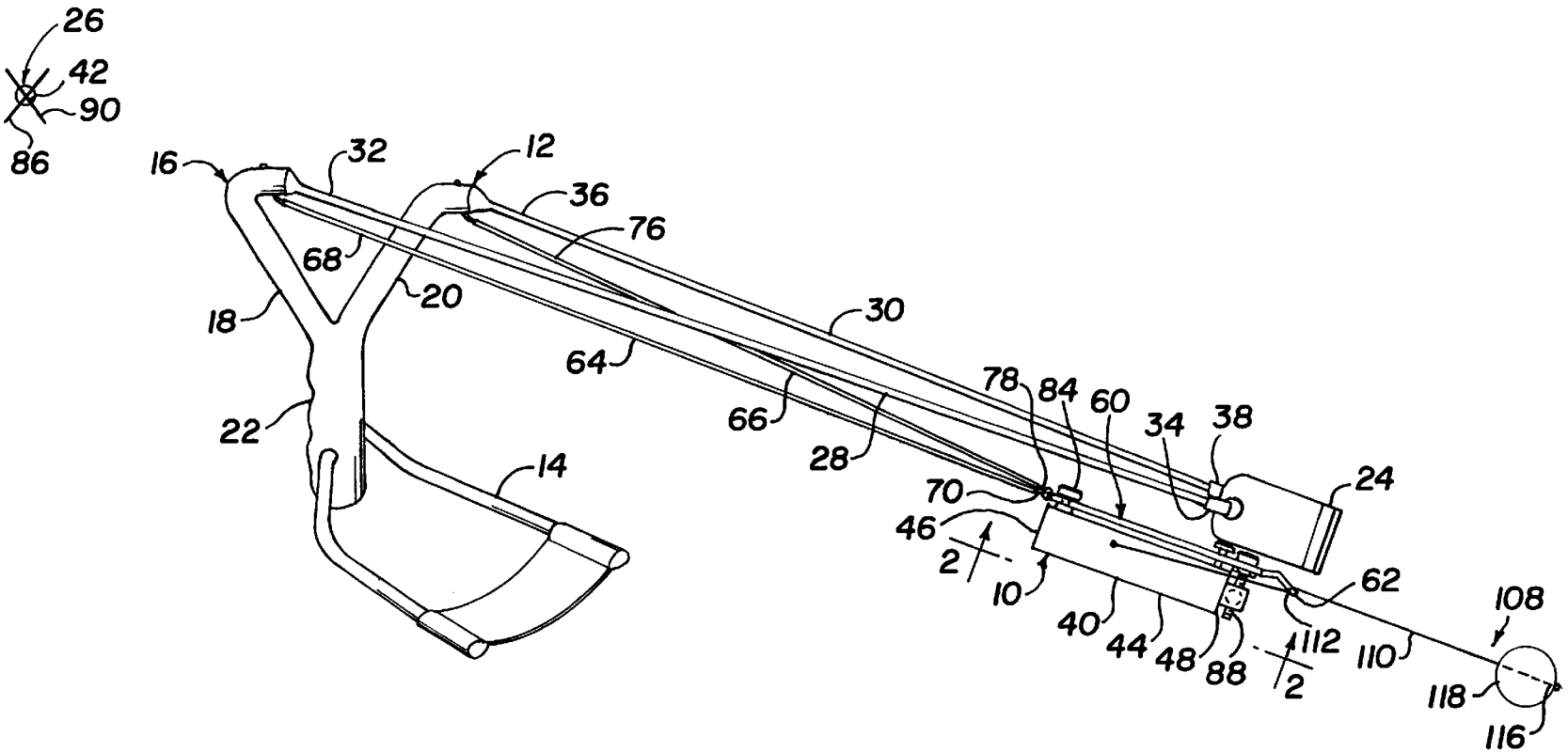
FIG. 1 is a side elevational view of an apparatus constructed according to the present invention connected to a slingshot.

Turning now to FIG. 1, there is shown an aiming apparatus 10 constructed according to the present invention connected to a conventional slingshot 12 with a folding wrist brace 14. Conventional slingshot 12 has a forked body 16 with a first arm 18 and a second arm 20 extending from a hand grip portion 22. Conventional slingshot 12 also has a pouch 24 for launching a projectile toward a target 26 and first and second elastic members 28 and 30, respectively, for providing the force to launch the projectile. First elastic member 28 has a first end 32 connected to first arm 18 in a conventional manner and a second end 34 connected to pouch 24 in a conventional manner. Second elastic member 30 has a first end 36 connected to second arm 20 in a conventional manner and a second end 38 connected to pouch 24 in a conventional manner.

As best seen in FIGS. 1–5, a light projecting device 40; preferably, a laser, is adapted to project a light beam 42. Light projecting device 40 has a support body 44 with a light projecting end 46 from which light beam 42 is projected and a rear end 48. Light projecting device 40 has a light source 50 disposed within support body 44, a switch 52 for selectively activating and deactivating light source 50 disposed within support body 44, and a power source 54, such as that provided by one or more conventional batteries, disposed within support body 44. When light projecting device 40 is a laser projecting device, light source 50 is a conventional laser diode 56 and control circuit 58 projecting light through a conventional lens 59 to provide light beam 42.

Figure 3:
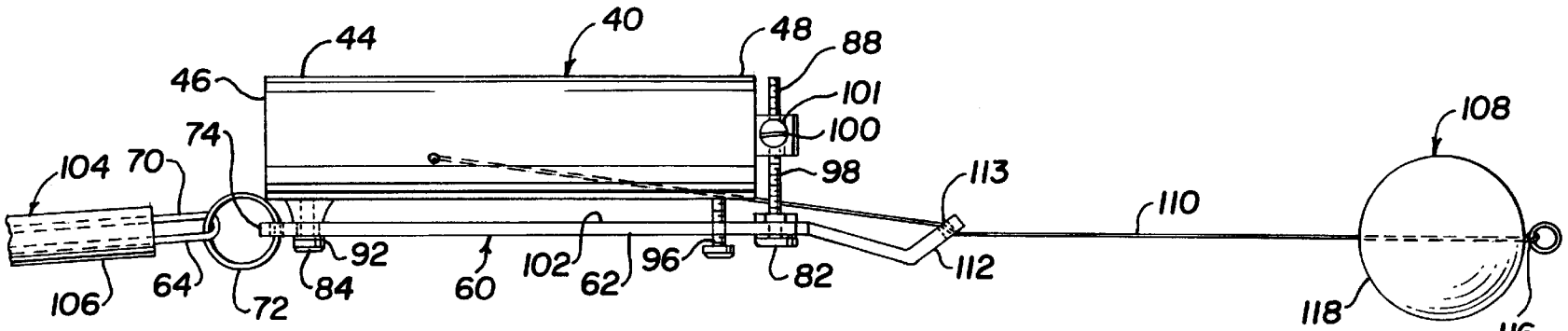
FIG. 3 is a side view, partly in section, of the portion of the apparatus shown in FIG. 2.
Figure 2:
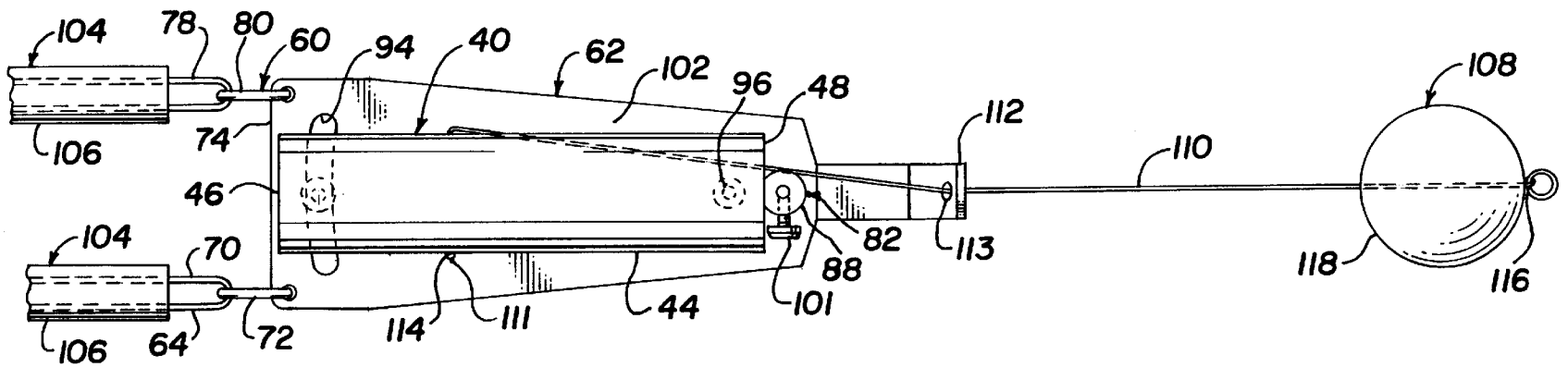
FIG. 2 is top plan view, partly in section, of a portion of the apparatus shown in FIG. 1 taken along lines 2—2 and in the direction of the arrows.
Figure 5:
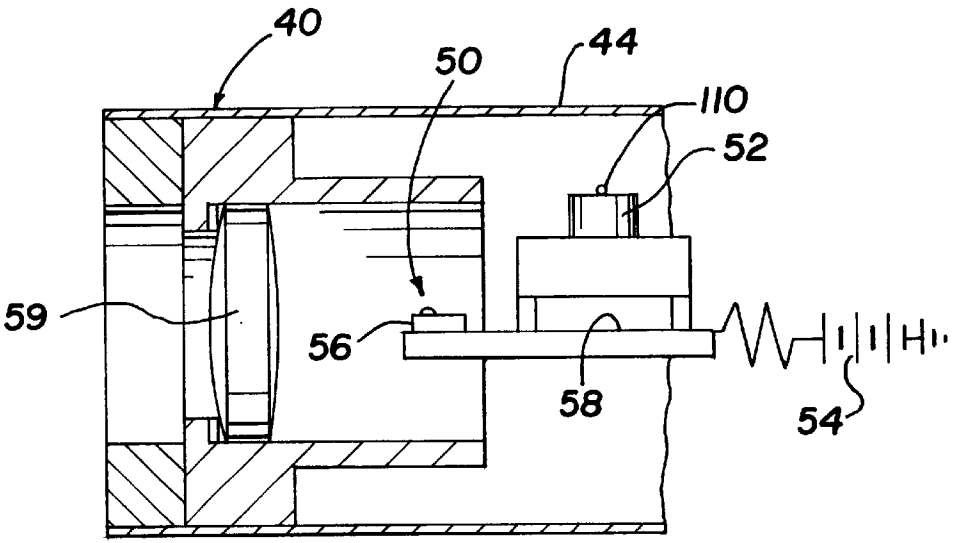
FIG. 5 is a elevational view, partly in section, of a schematic representation of the light projecting device used in accordance with the present invention.
Figure 4:
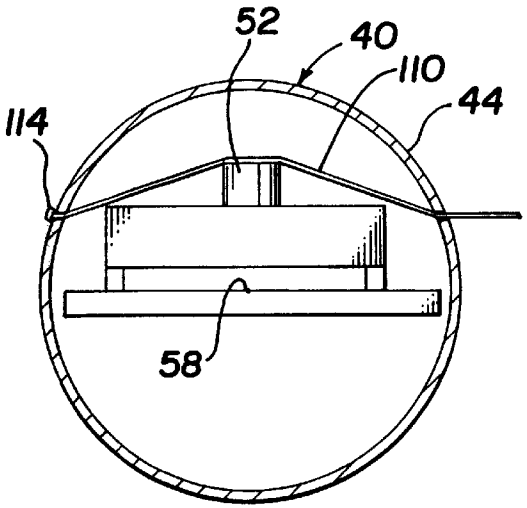
FIG. 4 is an elevational view, partly in section, illustrating the apparatus to activate and deactivate the light projecting device used in accordance with the present invention.

As best seen in FIGS. 1–3, mounting apparatus 60 is adapted to support light projecting device 40. Mounting apparatus 60 includes a mounting bracket 62 for supporting light projecting device 40.

Mounting apparatus 60 has first and second elastic members 64 and 66, respectively. First elastic member 64 has a first end 68 connected in close proximity to the location where first end 32 of slingshot elastic member 28 is connected to first arm 18 and a second end 70 connected by a ring 72 to a light projecting end 74 of mounting bracket 62. Second elastic member 66 has a first end 76 connected in close proximity to the location where first end 36 of slingshot elastic member 30 is connected to second arm 20 and a second end 78 connected by a ring 80 to light projecting end 74 of mounting bracket 62.

Mounting apparatus 60 has connecting apparatus 82 to connect light projecting device 40 to mounting bracket 62. Connecting apparatus 82 includes a first adjustable connecting device 84 to adjust light projecting device 40 relative to mounting bracket 62 within a first plane 86 and a second adjustable connecting device 88 to adjust light projecting device 40 relative to mounting bracket 62 within a second plane 90. The first and second planes 86 and 90, respectively, are disposed to extend in directions that are substantially transverse to one another. First adjustable connecting device 84 embodies a screw 92 extending through an slot 94 provided in mounting bracket 62 that is disposed for arcuate movement about pivotal connection 88. Second adjustable connecting device 88 embodies a rod 98 connected to connector 100 interconnecting rear end 48 of support body 44 to mounting bracket 62. Connector 100 is locked in position by a set screw 101 threadedly joined to connector 100. If desired, a screw 96 is threadedly connected to bracket 62 to allow minute adjustment of body 44 relative to bracket 62. First plane 86 is formed to extend substantially parallel to a surface 102 formed on mounting bracket 62 and second plane 90 is formed to extend substantially transverse to surface 102.

To prevent entanglement of between elastic members 28 and 30 of slingshot 12 with elastic members 64 and 66 of aiming apparatus 10, a movement restricting apparatus 104 is used. Movement restricting apparatus 104 allows substantially unfettered constricting movement of elastic members 64 and 66 while inhibiting other movement of elastic members 64 and 66 subsequent to the projectile being launched from slingshot 12. Movement restricting apparatus 104 includes an elongated thin walled tube 106 disposed to extend around each elastic member 64 and 66 and elongated to along the constricting axis of elastic members 64 and 66. Each elongated tube 106 of movement restricting apparatus 104 has a length less than a length of respective elastic member 64 and 66 prior to being moved to the projectile launching position to prevent interference with constricting movement of elastic members 64 and 66.

Aligning and light activating apparatus 108 is provided to align light beam 42 with target 26 and to activate light source 50 of light projecting device 40 in response to slingshot 12 being moved into the projectile launching position, as illustrated in FIG. 1. Aligning and light activating apparatus 108 includes a flexible and elongated member 110 having a length sufficient to be connected to support body 44 of light projecting device 40 as shown by knot 111 on the outside of support body 44, to engage light switch 52 of light projecting device 40 while extending between the sides of support body 44, to movably engage a directing shoulder 112 of mounting bracket 62 while passing through an aperture 113 in shoulder 112 and be held by a user of slingshot 12. Member 110 has a first end 114 connected to body 44 of light projecting device 40 with light beam 42 projecting away from flexible and elongated member 110 and a second end 116 disposed for directing light beam 42 into alignment with target 26 as slingshot 12 is moved into the projectile launching position. A spherical body 118 to assist in preventing the user's hand from slipping off flexible and elongated member 110 is connected to second end 116 of flexible and elongated member 110.

After aiming apparatus 10 is connected to slingshot 12, a user secures slingshot 12 in the normal matter for its use. The user then grasps flexible and elongated member 110 with the other hand places a projectile in pouch 24 and grasps pouch 24 with the other hand and draws pouch 24 and spherical body 118 toward the projectile launching position in the normal manner. While moving into the projectile launching position, member 110 engages switch 52 and activates light source 50. While in the projectile launching position, the user moves slingshot 12 until light beam 42 is positioned on target 26. When properly positioned, the user releases pouch 24 in the normal manner and observes the strike of the projectile. Should the projectile not strike target 26, the users makes the necessary adjustments to first adjustable connecting device 84 and second adjustable connecting device 88 and launches another projectile. After the launched projectile is striking target 26, aiming apparatus will provide consistent results.

When desired, aligning and light activating apparatus 108 can be modified. Should a light source be used that is not potentially harmful to a person's eyes, the light projecting device 40 may be on continuously. It that situation, flexible and elongated member 110 may be connected to directing shoulder 112 and used in the manner previously described.

Also it has been discovered that when pouch 24 is released and flexible and elongated member 110 retained in the user's hand, a motion dampening of slingshot 12 occurs when the projectile is launched from slingshot 12.

The invention having been described, what is claimed is:

1. An aiming apparatus for a slingshot, comprising: a light projecting device adapted to project a light beam; mounting apparatus adapted to support said light projecting device on the slingshot and disposed with the light beam being directed toward a target of a user of the slingshot; and light activating apparatus to activate said light projecting device in response to the slingshot being moved into a projectile launching position and connected to said light projecting device.

2. The apparatus set forth in claim 1, further comprising: said light projecting device including a light source and a switch to activate the light source; and said light activating apparatus including a light activating member disposed to engage the switch and activate the light source in response to the slingshot being moved into the projectile launching position.

3. The apparatus set forth in claim 2, further comprising: the light activating member of said light activating apparatus being flexible and elongated with an end connected to said light projecting device.

4. The apparatus set forth in claim 1, further comprising: said light projecting device including a light source and a switch to selectively activate and deactivate the light source; and said light activating apparatus including a light activating member disposed to activate the light source in response to the slingshot being moved into the projectile launching position and to deactivate the light source in response to the slingshot being moved out of the projectile launching position.

5. An aiming apparatus for a slingshot, comprising: a light projecting device adapted to project a light beam; and mounting apparatus adapted to support said light projecting device on the slingshot and disposed with the light beam being directed toward a target of a user of the slingshot; said mounting apparatus including a mounting bracket connected to an elastic member and connecting apparatus for connecting said light projecting device to the mounting bracket.

6. The apparatus set forth in claim 5, further comprising: the connecting apparatus of said mounting apparatus including a first adjustable connecting device to adjust said light projecting device relative to the mounting bracket within a first plane and a second adjustable connecting device to adjust said light projecting device relative to the mounting bracket within a second plane, the first and second planes being disposed to extend in directions that are substantially transverse to one another.

7. An aiming apparatus for a slingshot, comprising: a light projecting device adapted to project a light beam; and mounting apparatus adapted to support said light projecting device on the slingshot and disposed with the light beam being directed toward a target of a user of the slingshot; said mounting apparatus including an elastic member interconnecting first and second arms of the slingshot to said light projecting device.

8. The apparatus set forth in claim 7, further comprising: movement restricting apparatus to allow substantially unfettered constricting movement of the elastic member while inhibiting other movement of the elastic member subsequent to the projectile being launched from the slingshot.

9. The apparatus set forth in claim 8, further comprising: the movement restricting apparatus including an elongated tube disposed to extend around the elastic member and along the constricting axis of the elastic member.

10. The apparatus set forth in claim 9, further comprising: the elongated tube of the movement restricting apparatus having a length less than a length of the elastic member prior to being moved to the projectile launching position.

11. An aiming apparatus for use with a slingshot, comprising: a light projecting device adapted to project a light beam, said light projecting device including a light projecting end to project the light beam toward a target of a user of the slingshot; mounting apparatus adapted to support said light projecting device, said mounting apparatus including an elastic member interconnecting first and second arms of the slingshot to the light projecting end of said light projecting device; and an aligning apparatus to align the light beam with a target, said aligning apparatus including a flexible and elongated member having a length sufficient to be held by a user of the slingshot, and a first end connected to said light projecting device with the light beam projecting away from the flexible and elongated member, and a second end of said flexible and elongated member disposed for directing the light beam into alignment with a target as the slingshot is moved into a projectile launching position.

12. The apparatus set forth in claim 11, further comprising: said aligning apparatus including a stop member connected to the second end of the flexible and elongated member to prevent inadvertent release by the user of the flexible and elongated member.

13. The apparatus set forth in claim 11, further comprising: said light projecting device including a light source and a switch to activate the light source; and the flexible and elongated member of said aligning apparatus being disposed to engage the switch and activate the light source in response to the slingshot being moved into the projectile launching position.

14. The apparatus set forth in claim 13, further comprising: the flexible and elongated member of said aligning apparatus having the first end connected to said light projecting device.

15. The apparatus set forth in claim 14, further comprising: said light projecting device including a light source and a switch to selectively activate and deactivate the light source; and the flexible and elongated member of said aligning apparatus being disposed to engage the switch and activate the light source in response to the slingshot being moved into the projectile launching position and to deactivate the light source in response to the slingshot being moved out of the projectile launching position.

16. The apparatus set forth in claim 15, further comprising: said light projecting device being a laser.

17. The apparatus set forth in claim 11, further comprising: said mounting apparatus including a mounting bracket connected to the elastic member and connecting apparatus for connecting said light projecting device to the mounting bracket.

18. The apparatus set forth in claim 17, further comprising: the connecting apparatus of said mounting apparatus including a first adjustable connecting device to adjust said light projecting device relative to the mounting bracket within a first plane and a second adjustable connecting device to adjust said light projecting device relative to the mounting bracket within a second plane, the first and second planes being disposed to extend in directions that are substantially transverse to one another.

19. The apparatus set forth in claim 11, further comprising: movement restricting apparatus to allow substantially unfettered constricting movement of the elastic member while inhibiting other movement of the elastic member subsequent to the projectile being launched from the slingshot.

20. The apparatus set forth in claim 19, further comprising: the movement restricting apparatus including an elongated tube disposed to extend around the elastic member and along the constricting axis of the elastic member.

21. The apparatus set forth in claim 20, further comprising: the elongated tube of the movement restricting apparatus having a length less than a length of the elastic member prior to being moved to the projectile launching position.

22. An aiming apparatus for use with a slingshot, comprising: a light projecting device adapted to project a light beam, said light projecting device including a support body having a light projecting end to project the light beam, a light source connected to the body and a switch to selectively activate and deactivate the light source; mounting apparatus adapted to support said light projecting device, said mounting apparatus including a mounting bracket to support said light projecting device having a directing shoulder, first and second elastic members, each elastic member having first and second ends, the first end of each elastic member being connected to an arm of the slingshot in close proximity to the location of attachment by a slingshot elastic member, the second end of each elastic member being connected to the mounting bracket; connecting apparatus for connecting said light projecting device to the mounting bracket, said connecting apparatus of said mounting apparatus including a first adjustable connecting device to adjust said light projecting device relative to the mounting bracket within a first plane and a second adjustable connecting device to adjust said light projecting device relative to the mounting bracket within a second plane, the first and second planes being disposed to extend in directions that are substantially transverse to one another; movement restricting apparatus to allow substantially unfettered constricting movement of the elastic members while inhibiting other movement of the elastic member subsequent to the projectile being launched from the slingshot, said movement restricting apparatus including an elongated tube disposed to extend around each elastic member and along the constricting axis of the elastic member, the elongated tube of the movement restricting apparatus having a length less than a length of the respective elastic member prior to being moved to the projectile launching position; and aligning and light activating apparatus to align the light beam with a target and activate the light source of said light projecting device in response to the slingshot being moved into a projectile launching position, said aligning and light activating apparatus including a flexible and elongated member having a length sufficient to be connected to the support body of said light projecting device, to engage the light switch of said light projecting device, to movably engage the directing shoulder of said mounting bracket and be held by a user of the slingshot, and a first end connected to the body of said light projecting device with the light beam projecting away from the flexible and elongated member, and a second end of said flexible and elongated member disposed for directing the light beam into alignment with a target as the slingshot is moved into the projectile launching position.

* * * * *